United States Patent [19]

Aho et al.

[11] Patent Number: 5,029,060

[45] Date of Patent: Jul. 2, 1991

[54] UNIFORM INTENSITY PROFILE CATADIOPTRIC LENS

[75] Inventors: Kenneth A. Aho, Chisago City, Minn.; John C. Nelson, The Sea Ranch, Calif.

[73] Assignee: Minnesota Mining and Manufacturing Company, St. Paul, Minn.

[21] Appl. No.: 554,017

[22] Filed: Jul. 17, 1990

[51] Int. Cl.[5] ..... F21V 7/00

[52] U.S. Cl. ..... 362/299; 362/309; 362/329

[58] Field of Search ..... 362/299, 302, 304, 309, 362/327, 328, 329, 340

[56] References Cited

U.S. PATENT DOCUMENTS 2,015,235 9/1935 Rolph ..... 362/340

4,962,450 10/1990 Reshetin ..... 362/299 X

*Primary Examiner*—Stephen F. Husar

*Attorney, Agent, or Firm*—Gary L. Griswold; Walter N. Kirn; Stephen W. Buckingham

[57] ABSTRACT

The present invention is a light fixture having a reflector designed to discard preselected amounts of light from a light source. The percentage of the light discarded will vary over the surface of the reflector in order to provide a predetermined output intensity distribution.

15 Claims, 1 Drawing Sheet

UNIFORM INTENSITY PROFILE CATADIOPTRIC LENS

BACKGROUND OF THE INVENTION

A common desire in designing a lighting fixture is to provide such a fixture such that it will provide a uniform level of illumination across its entire aperture. Various techniques have been used to accomplish this. For example, one such light fixture is shown in commonly-assigned U.S. Pat. No. 4,791,540. The system of that patent uses specialized film in the aperture in order to ensure that the light will undergo multiple reflections before emerging. In this way the light is evenly distributed throughout the optical cavity providing a uniform intensity output.

Another technique is shown in commonly-assigned copending application Ser. No. 192,212, filed May 10, 1988. According to the technique taught therein, a Fresnel-type reflector is provided wherein some of the Fresnel structures have multiple active faces. Some of these faces are used to direct light out of the light fixture in the intended direction, while others are used to discard excess light in areas close to the light source.

SUMMARY OF THE INVENTION

According to the invention a light fixture has a housing defining an optical cavity with an optical window for allowing light to escape from the housing. The light fixture further has a light source within the optical cavity. A reflector has a main body of a transparent material with a smooth surface and a structured surface. The smooth surface has a reflective layer adjacent thereto. The structured surface has a plurality of triangular prisms formed thereon. Each of the triangular prisms has a transmissive facet and a reflective facet, the transmissive facets making first angles with the smooth surface and the reflective facets making second angles with a normal to the smooth surface, where the first and second angles for each prism are chosen such that the light fixture will provide a preselected light intensity distribution over the optical window.

DETAILED DESCRIPTION OF A PREFERRED EMBODIMENT

Figure 1:
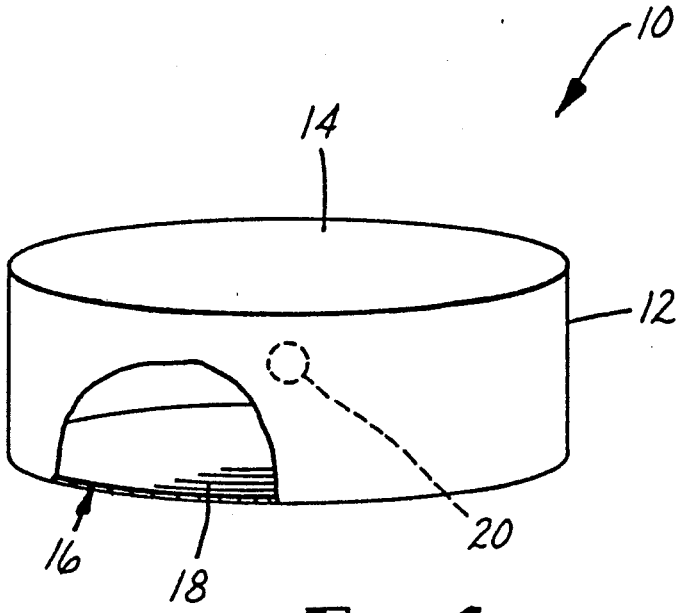
FIG. 1 is a view of a light fixture according to the invention.

FIG. 1 illustrates an embodiment of the invention. In FIG. 1 a light fixture, 10, includes a housing 12 defining an optical cavity. It also includes an optical window 14 through which the light escapes. Furthermore it includes a reflector, 16, having a structured surface. The structures are schematically shown as 18 and and are typically circular and concentric. Light fixture 10 also includes a light source, 20.

Figure 2:
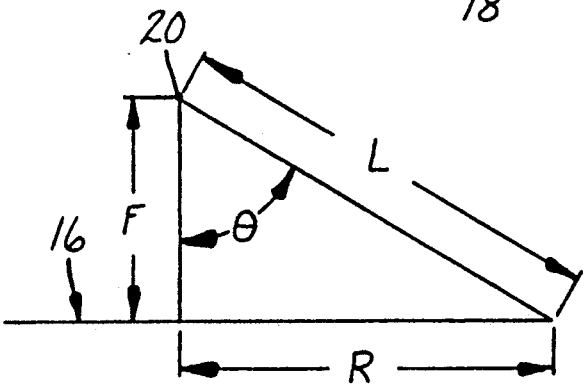
FIG. 2 is a schematic diagram of a light fixture according to the invention.

FIG. 2 schematically shows the light fixture of the invention in order to define some of the symbols to be used in the subsequent description. F is the focal length of reflector 16 and represents the distance between light source 20 and reflector 16. R is the radial distance from the center of reflector 16 to a point under consideration. L is the distance from light source 20 to the point under consideration. The angle of incidence of a light ray on reflector 16 is identified as $\theta$.

The goal in designing a light fixture according to the invention is to provide the appearance of a uniform light intensity across the aperture. The expression appearance is used because, in most situations, some variation will not be noticeable. Typically an intensity ratio as great as three to one from the brightest to darkest region will not be noticed.

Thus the designer of a light fixture must specify a desired intensity profile for the aperture of the fixture. Such a profile may be expressed as shown below.

$$I(R)=(V-1)((R_{max}-R)/(R_{max}-R_{min}))+1$$

In this expression I is the intensity of the light projected on the optical window expressed as a function of the radial distance from the center of aperture. V is the permitted variation in intensity, expressed as a ratio of the brightest to darkest region. $R_{max}$ is the distance from the center of the aperture to the outer edge. $R_{min}$ is the radius of a central zone that is excluded from the calculation. If the region of uniformity is to go the center of the aperture, $R_{min}$ is set equal to zero.

The actual intensity profile obtained from a light fixture may be expressed as $$I(R)=\alpha(\cos(\theta)/L^2)T(R)\phi(\theta)$$

where T is transmission function of the lens, or in this case of the reflector, expressed as a function of R and $\phi(\theta)$ is the light source intensity as a function of incident angle. For an ideal source $\phi(\theta)$ is constant, but for a real source it may be necessary to consider it. In this expression $\alpha$ is a proportional constant.

Combining these equations yields:

$$\alpha=T_{max}(\cos(\theta_{max}))/(\phi(\theta_{max})I(R_{max})R_{max}^2)$$

where $T_{max}$ is value of the transmission function at $R_{max}$ and $\theta_{max}$ is the value of $\theta$ at $R_{max}$. Once the transmission function has been defined, a reflector is designed to provide that transmission function. That may be done iteratively, using a ray trace model.

Figure 3:
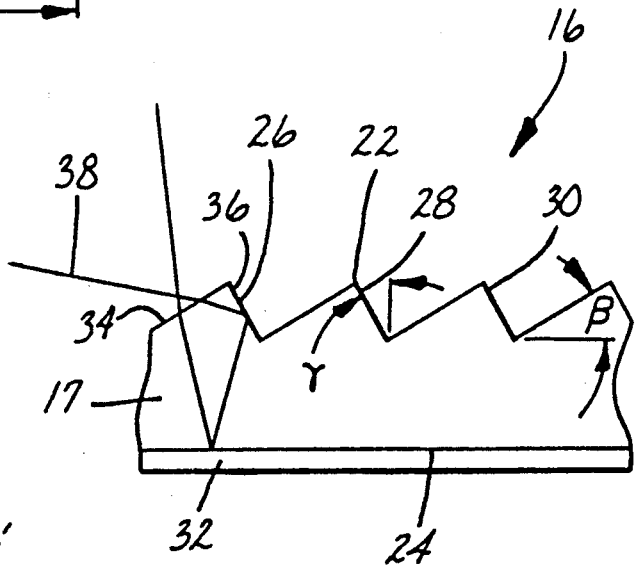
FIG. 3 is a side view of a first portion of a reflector for use in a light fixture according to the invention.

FIG. 3 illustrates a portion of a typical reflector that may be used as reflector 16. The main body of reflector 16, identified by reference number 17, is of a transparent material such as polycarbonate or an acrylic material. Reflector 16 has a structured surface, 22, and a smooth surface, 24. Structured surface 22 has structures 26, 28, and 30. Smooth surface 24 is provided with a reflective layer, 32. In a preferred embodiment reflective layer 32 is a specular reflector although in some applications it could be a diffuse reflector. Reflective layer 32 may be, for example, a layer of a vapor coated metal such as aluminum. It should be noted that the term "smooth" as used to describe surface 24 is a relative term and the surface could have a matte finish in order that a vapor coated metal on surface 24 would provide a diffuse reflector.

Structure 26 on structured surface has facets 34 and 36 making it a triangular prism. A light ray, 38, from light source 20, enters main body 17 through facet 34 and is refracted. Light ray 38 then travels across structure 26 to facet 36 where it undergoes total internal reflection. It next is reflected by reflective layer 32 and emerges from reflector 16 through facet 34. Thus facet 34 may be called a transmissive facet and facet 36 may be called a reflective facet.

The shape of each of the structures on structured surface 22 is defined by the selection of two angles, identified as angles $\beta$ and $\gamma$ on structure 26. Angle $\beta$ is the angle between transmissive facet 34 and smooth surface 24 while angle $\gamma$ is the angle between reflective facet 36 and a normal to smooth surface 24. Angle $\beta$ is chosen to provide the desired transmission function for a particular position on reflector 16 and angle $\gamma$ is chosen to insure that the light emerges through optical window 14 in the desired direction. Assuming that a uniform intensity profile across optical window 14 is desired, that the angular intensity distribution of light source 20 is a constant and that all of the structures will be of the same height, both angle $\beta$ and angle $\gamma$ must increase as R increases. A greater value for angle $\beta$ will provide an increased transmission function because more of the light entering the structure through the transmissive facet will strike the reflecting facet. Light that does not strike a reflecting facet of a prism is effectively discarded from the output beam.

Figure 4:
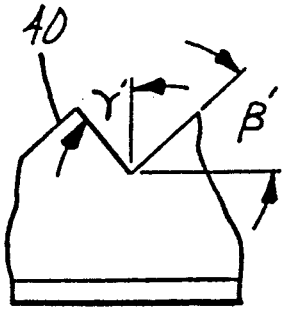
FIG. 4 is a side view of a second portion of a reflector for use in a light fixture according to the invention.

By way of contrast with the structures shown in FIG. 3, which might be designed to be positioned relatively close to light source 20, structure 40 of FIG. 4 would be intended for use at a greater value of R. As may be seen the sizes of $\beta'$ and $\gamma'$ of structure 40 are greater than those of $\beta$ and $\gamma$ of structure 26 of FIG. 3.

EXAMPLE

A reflector was designed for a light fixture having a focal length of 1.25 inches, an $R_{min}$ of 1.0 inch, an $R_{max}$ of 7 inches, a fall-off factor (V) of 3 and a constant source angular intensity distribution. Given these assumptions the values of $\theta$ and desired values T(R) were calculated for a variety of values of R. The calculated values are shown in the table below.

| R (inches) | $\theta$ (degrees) | T(R) |
|---|---|---|
| 1 | 38.66 | .027 |
| 2 | 57.99 | .079 |
| 3 | 63.38 | .182 |
| 4 | 72.65 | .338 |
| 5 | 75.96 | .53 |
| 6 | 78.23 | .73 |
| 7 | 79.87 | .89 |

Given the values above and an index of refraction of 1.586, the values of angles $\beta$ and $\gamma$ may be calculated. These values are shown in the table below.

| R (inches) | $\gamma$ (degrees) | $\beta$ (degrees) |
|---|---|---|
| 1 | 11.75 | 3.52 |
| 2 | 16.62 | 4.26 |
| 3 | 19.01 | 8.53 |
| 4 | 21.26 | 19.92 |
| 5 | 22.29 | 23.64 |
| 6 | 22.98 | 26.14 |
| 7 | 23.87 | 40.00 |

What is claimed is:

1. A light fixture comprising:

a housing defining an optical cavity having an optical window for allowing light to escape from said cavity;

a light source in said optical cavity; and a reflector for directing light from said optical cavity through said optical window, said reflector having a main body of a transparent material, said main body having a smooth surface with a reflective layer adjacent thereto and a structured surface, said structured surface having a plurality of triangular prisms formed thereon, each said prisms having a transmissive facet and a reflective facet positioned such that light from said light source will enter said main body through one of said transmissive facets, be totally internally reflected by one of said reflective facets and exit through one of said transmissive facets, where each of said transmissive facets makes a first angle with said smooth surface and each of said reflective facets makes a second angle with a normal to said smooth surface, said first and second angles for each of said prisms being selected to provide preselected light intensity distribution over said optical window.

2. The light fixture of claim 1 wherein said triangular prisms are circular and concentric.

3. The light fixture of claim 2 wherein said reflective layer is a specular reflector.

4. The light fixture of claim 3 wherein said reflective layer is formed by a metal vapor coated on said smooth layer.

5. The light fixture of claim 2 wherein said reflective layer is a diffuse reflector.

6. The light fixture of claim 5 wherein said reflective layer is formed by a metal vapor coated on said smooth layer.

7. The light fixture of claim 1 wherein said intensity distribution has a region of greatest intensity and a region of least intensity and said region of greatest intensity has an intensity no more than three times as great as that in said region of least intensity.

8. The light fixture of claim 7 wherein said reflective layer is a specular reflector.

9. The light fixture of claim 8 wherein said reflective layer is formed by a metal vapor coated on said smooth layer.

10. The light fixture of claim 7 wherein said reflective layer is a diffuse reflector.

11. The light fixture of claim 10 wherein said reflective layer is formed by a metal vapor coated on said smooth layer.

12. The light fixture of claim 1 wherein said reflective layer is a specular reflector.

13. The light fixture of claim 12 wherein said reflective layer is formed by a metal vapor coated on said smooth layer.

14. The light fixture of claim 1 wherein said reflective layer is a diffuse reflector.

15. The light fixture of claim 14 wherein said reflective layer is formed by a metal vapor coated on said smooth layer.

* * * * *